US006666364B2

(12) United States Patent
Phelps

(10) Patent No.: US 6,666,364 B2
(45) Date of Patent: Dec. 23, 2003

(54) EASY LOADING DISPENSER

(75) Inventor: Stephen L. Phelps, Lilburn, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/013,134

(22) Filed: Dec. 7, 2001

(65) Prior Publication Data

US 2003/0106922 A1 Jun. 12, 2003

(51) Int. Cl.[7] ..... B26F 3/02
(52) U.S. Cl. ..... 225/106; 225/46; 242/570
(58) Field of Search ..... 225/46, 106; 242/419.4, 242/487.2, 533, 570, 571.8, 55.2

(56) References Cited

U.S. PATENT DOCUMENTS

| | | | | | |
|---|---|---|---|---|---|
| 2,095,419 | A | | 10/1937 | Pollard | |
| 2,555,885 | A | * | 6/1951 | Hope | 242/596.4 |
| 2,583,411 | A | | 1/1952 | Carlin | |
| 2,643,069 | A | | 6/1953 | Carlin | |
| 2,879,012 | A | | 3/1959 | Sarro | |
| 2,928,618 | A | | 3/1960 | Locke | |
| 2,978,197 | A | * | 4/1961 | Anderson | 242/596.5 |
| 3,235,196 | A | | 2/1966 | Platt | |
| 3,428,267 | A | | 2/1969 | Briles | |
| 3,623,676 | A | | 11/1971 | Eckels | |
| 3,729,145 | A | | 4/1973 | Koo | |
| 3,790,097 | A | | 2/1974 | Wormly | |
| 3,806,057 | A | | 4/1974 | Whatley | |
| 3,847,365 | A | * | 11/1974 | Carol | 242/596.7 |
| 3,865,323 | A | | 2/1975 | Stronge et al. | |
| 3,878,998 | A | | 4/1975 | Lazzari | |
| 3,963,190 | A | | 6/1976 | Wilson | |
| 4,179,078 | A | | 12/1979 | Mansfield | |
| 4,222,532 | A | | 9/1980 | DeLuca | |
| 4,452,403 | A | | 6/1984 | Arronte | |
| 4,614,312 | A | | 9/1986 | Del Pino | |
| 4,662,576 | A | | 5/1987 | Paul | |
| 5,253,818 | A | | 10/1993 | Craddock | |
| 5,318,210 | A | | 6/1994 | Morand | |
| 5,605,304 | A | * | 2/1997 | Ahern, Jr. | 242/588 |
| 5,620,148 | A | | 4/1997 | Mitchell | |
| 5,697,576 | A | | 12/1997 | Bloch et al. | |
| 5,782,428 | A | | 7/1998 | Chabot | |
| 5,868,347 | A | | 2/1999 | Paul et al. | |
| D428,286 | S | | 7/2000 | Phelps et al. | |
| 6,092,758 | A | | 7/2000 | Gemmell | |
| 6,092,759 | A | | 7/2000 | Gemmell et al. | |
| 6,138,939 | A | * | 10/2000 | Phelps et al. | 242/596.7 |
| 6,186,439 | B1 | * | 2/2001 | Carey | 242/596.3 |
| 6,189,828 | B1 | | 2/2001 | Reilly | |
| 6,286,781 | B1 | * | 9/2001 | Lai | 242/596.4 |

FOREIGN PATENT DOCUMENTS

| | | |
|---|---|---|
| CH | 325795 | 11/1957 |
| DE | 3631828 | 4/1987 |
| LU | 35501 | 10/1957 |

* cited by examiner

*Primary Examiner*—Allan N. Shoap
*Assistant Examiner*—Phong Nguyen
(74) *Attorney, Agent, or Firm*—Dana E. Stano

(57) ABSTRACT

Opposed cantilevered adapters are provided for supporting a roll of material. The adapters have a roll bearing surface, a projection surface with a first end and a second end such that the first end is coterminous and substantially perpendicular to the roll bearing surface at each point along an interface formed therebetween, and an actuating surface angularly coterminous with the second end of the projection surface.

12 Claims, 5 Drawing Sheets

EASY LOADING DISPENSER

BACKGROUND OF THE INVENTION

The present invention relates to dispensers of rolled products, and more particularly to dispensers having features that permit simple and easy insertion and removal of a roll of material into the dispenser.

Dispensing of rolled paper products such as paper toweling, bathroom tissue, and the like, is common in commercial facilities such as airports, manufacturing plants, and shopping malls. Rolled paper products are dispensed in different areas within these facilities, such as restrooms and work areas. In such facilities, it is important to use maintenance personnel in an efficient manner, including minimizing both the number of visits maintenance personnel must make to these locations as well as the amount of time expended tending to the dispensers on each visit.

To install a roll of material into many of the currently available dispensers, maintenance personnel must thread the leading end of the rolled paper product through a series of rollers so that the product dispenses properly. Additionally, some dispensers require that the roll of paper product be installed in the dispenser so that the roll rotates in a particular direction. If the roll of paper product is not loaded correctly, the product may not dispense properly. Such dispensers require maintenance personnel to spend additional time ensuring that the roll of paper product is loaded correctly into the dispenser and threaded properly through the dispensing mechanism. Thus, it is desirable to utilize a dispenser that permits rolls of paper product to be easily and correctly loaded into the dispenser in a rapid and efficient manner.

SUMMARY OF THE INVENTION

The present invention relates to opposed cantilevered adapters for supporting a roll of material. The adapters have a roll bearing surface, a projection surface with a first end and a second end such that the first end is substantially coterminous and substantially perpendicular to the roll bearing surface at each point along an interface formed therebetween, and an actuating surface angularly coterminous with the second end of the projection surface. The cantilevered adapters are mounted on opposed rigid surfaces in coaxially aligned, spaced apart relation such that the application of a biasing force applied to the actuating surface causes the adapters to deflect in a direction away from the opposed adapter, and removal of the biasing force causes the adapter to protrude toward the opposed adapter. The adapters may further include a connecting portion contiguous to the actuating surface and distal to the projection surface for joining the adapters to the opposed rigid surfaces. The roll bearing surface is sufficiently distal to the opposed rigid surfaces, thereby permitting adequate deflection for insertion or removal of the roll.

The present invention also relates to a dispenser for dispensing a material from a cored roll having a housing having a plurality of opposed walls forming an interior volume and an opening, a means for dissociating the material from the roll disposed proximal to the opening, and at least one pair of cantilevered adapters mounted on opposed walls within the interior volume in substantially coaxially aligned, spaced apart relation. At least one adapter further comprises a roll bearing surface, a projection surface having a first end and a second end such that the first end is substantially coterminous with the roll bearing surface, and an actuating surface angularly coterminous with the second end of the projection surface. The first end and the bearing surface are substantially perpendicular at each point along the interface therebetween. The application of a biasing force to the actuating surface causes the adapters to deflect in a direction away from the opposed adapter, and removal of the biasing force causes the adapter to protrude toward the opposed adapter. The dispenser may further include adapters having a connecting portion contiguous to the actuating surface and distal to the projection surface for joining the adapters to the opposed walls. The connecting portion positions the roll bearing surface sufficiently distal to the opposed walls to permit adequate deflection for insertion or removal of the roll.

DESCRIPTION OF THE INVENTION

Figure 1:
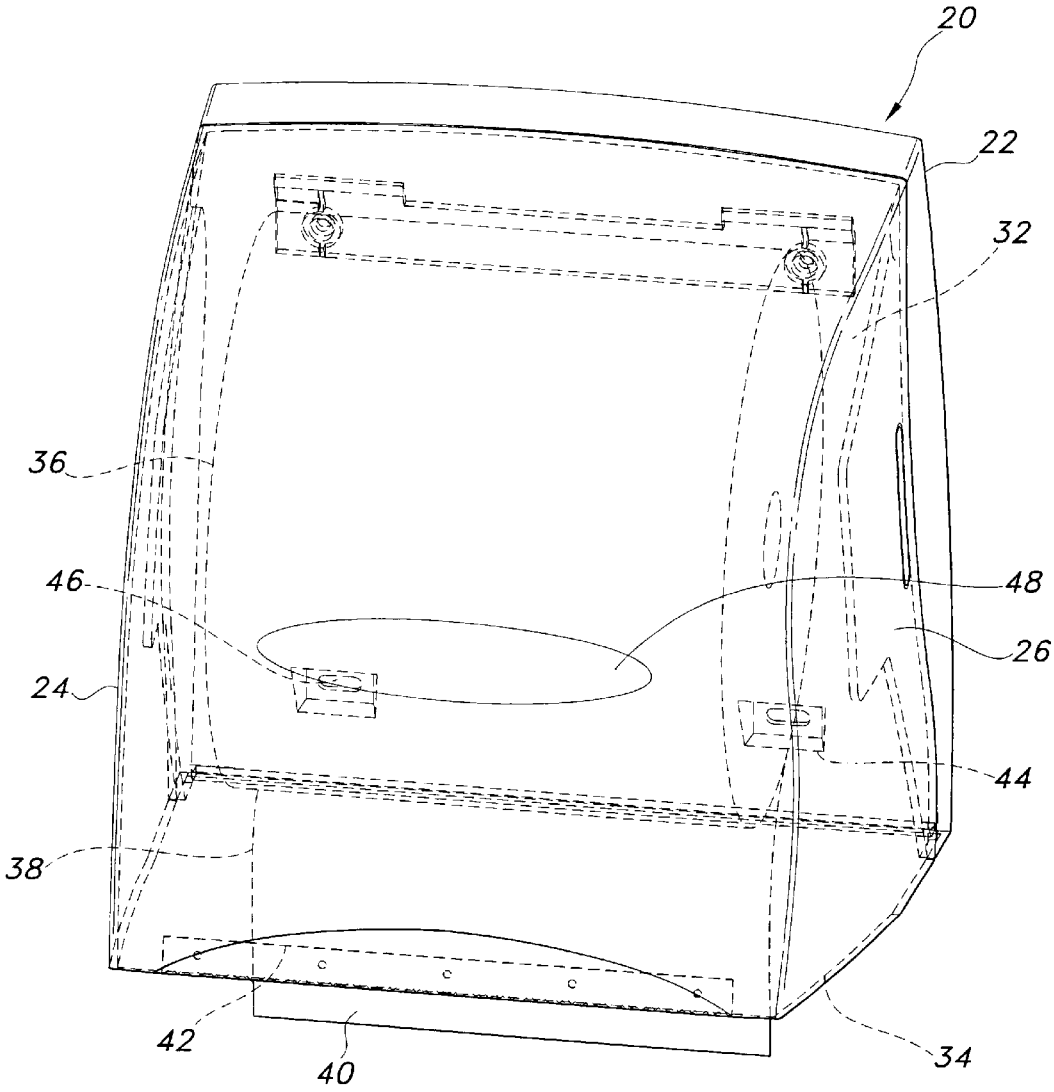
FIG. 1 is a perspective view of a dispenser.

The present invention relates to a dispenser of rolled materials, such as, for example, rolled paper products. An embodiment of a dispenser according to the present invention is depicted in FIG. 1. The dispenser 20 shown therein includes a housing 22 having a plurality of walls, including at least two side walls 24 and 26, the plurality of walls defining an interior volume 32 and an opening 34 therethrough. A roll 36 of a material 38 is contained within and dispensed from the interior volume 32 of the housing 22. A tail 40 of the material 38 extends from the opening 34 and allows users to remove the material 38 from the housing 22. A blade 42 or other cutting means proximal to the opening 34 serves as a tear point for material 38 dispensed from the housing 22. The housing 22 is typically mounted on a rigid surface such as, for example, a restroom wall or stall. A possible manner of mounting the housing 22 to a surface may include providing mounting blocks 44 having fastener holes 46 on the exterior of the housing 22. Alternative methods of mounting the dispenser 20 are possible and will be known to those skilled in the art. The dispenser 20 may optionally have a window 48 made of translucent or transparent material for viewing the roll 36 as it is depleted.

Figure 2:
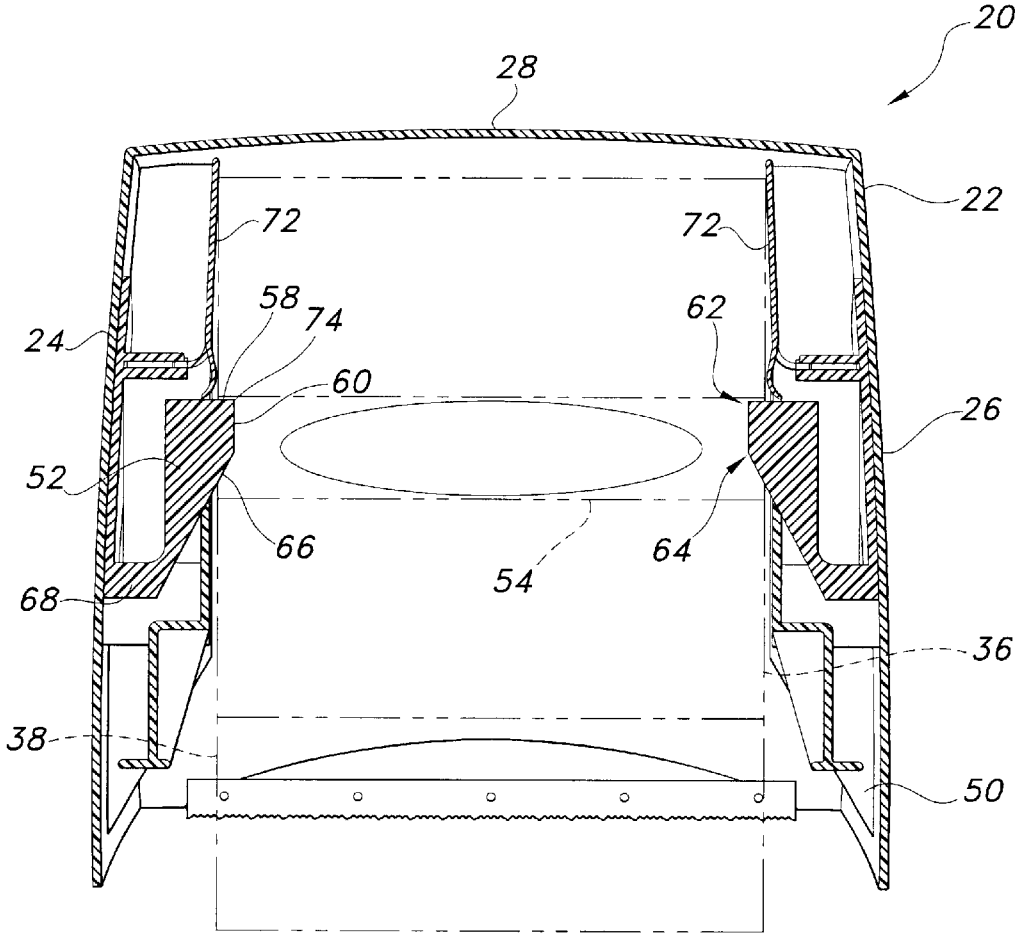
FIG. 2 shows a rear elevational view of a cored roll mounted in the dispenser.

FIG. 2 depicts in greater detail the dispenser 20 of the present invention. Angular guides 50 may be provided within the housing 22 to assist in directing the roll 36 during loading. At least one pair of cantilevered adapters 52 mounted on opposed rigid surfaces, for example, walls 24 and 26, within the interior 32 in substantially coaxially aligned, spaced apart relation extend into a core 54 of the roll 36 and provide a fixed mounting axis upon which the material 38 is dispensed. At least one adapter 52 of each pair of cantilevered adapters 52 has a roll bearing surface 58, a projection surface 60 having a first end 62 and a second end 64 such that the first end 62 is substantially coterminous and substantially perpendicular to the roll bearing surface 58 at each point along an interface 74 formed therebetween, and an actuating surface 66 angularly coterminous with the second end 64 of the projection surface 60. In some embodiments, the projection surface 60 is substantially parallel to the opposed rigid surfaces to which the adapter 52 is mounted, for example, walls 24 and 26. Further, in some embodiments, the roll bearing surface 58 is substantially perpendicular to the opposed rigid surfaces to which the adapter 52 is mounted, for example, walls 24 and 26.

Figure 3:
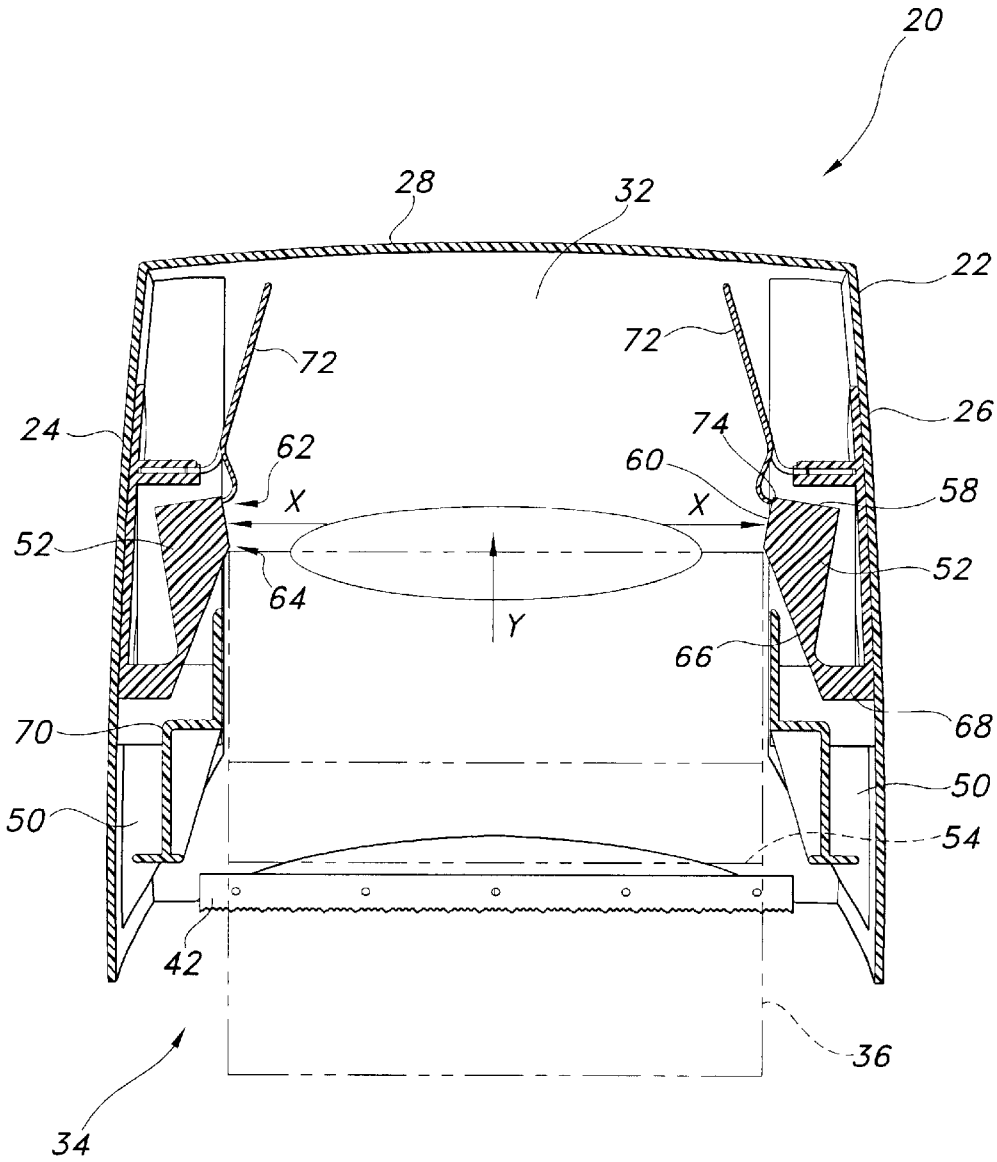
FIG. 3 depicts a cross-sectional view of loading a dispenser.

The adapters 52 are designed not only to engage the core 54 of the roll 36 for dispensing, but also to facilitate both insertion and removal of the roll 36. FIG. 3 depicts insertion of a cored roll 36 into the dispenser 20. The roll 36 may be held so that the core 54 is roughly parallel to the dispenser opening 34 and may be oriented so that it rotates advantageously in either a clockwise or a counterclockwise direction unlike some prior art apparatuses. As the roll 36 is moved into the housing 22 in a direction Y, the roll 36 is urged toward the opposed adapters 52 by, for example, angular guides 50.

As the roll 36 is pushed further into the dispenser 20, the roll 36 contacts the actuating surface 66 (FIG. 5) of the adapters 52. The adapters 52 are mounted on opposed rigid surfaces in substantially coaxially aligned, spaced apart relation such that the application of a biasing force applied to the actuating surface 66 causes the adapters 52 to deflect in a direction X away from the opposed adapter, and removal of the biasing force causes the adapter 52 to protrude toward the opposed adapter 52. In some embodiments, the opposed rigid surfaces may be opposed walls 24, 26 of the dispenser 20. As a result, each adapter 52 deflects in a direction X away from the opposed adapter 52. The adapters 52 should be designed to deflect sufficiently to enable the roll 36 to clear the projection surface 60 of the adapters 52. The distance that the adapters 52 deflect is limited by contact with the walls 24, 26 or other components of the dispenser 20. Thus, the adapters 52 should be appropriately dimensioned and made of a suitable material to permit sufficient deflection.

When the core 54 of the roll 36 is aligned with the projection surface 60 of the adapters 52, the biasing force is removed and the adapters 52 project toward the roll 36 (FIG. 2). The projection surface 60 is then located inside the core 54 of the roll 36 and the roll bearing surface 58 is available to provide an axis about which the roll 36 rotates for dispensing the material 38 (FIG. 2). For this to occur, the projection surface 60 should be dimensioned to fit within the core 54 of the roll 36.

Though both adapters 52 are depicted having an actuating surface 66, it should be understood that only one adapter 52 need be configured with an actuating surface 66 having a geometry adapted to deflect in a direction X away from its opposed paired adapter 52 upon application of a biasing force. Such a biasing force may be applied by insertion or removal of the roll 36, or by use of a release mechanism 70, shown in FIGS. 3–5. Removal of the biasing force causes the adapter 52 to protrude toward its opposed paired adapter 52 thereby making the roll bearing surface 58 available for mounting the roll 36. When only one adapter 52 has an actuating surface 66 (not shown), the roll 36 is mounted by first positioning one end of the roll 36 on the other adapter 52, then the other end of the roll 36 is advanced toward the adapter 52 having the actuating surface 66. The application of the biasing force to the actuating surface 66 will cause the adapter 52 to move in a direction X away from the opposed adapter 52, thereby creating sufficient space for the roll 36 to pass by the adapter 52 and be mounted thereon.

Returning to FIG. 2, when the roll 36 is mounted within the housing 22, the adapters 52 engage the core 54 of the roll 36. The roll 36 is supported by the roll bearing surface 58 of the adapters 52, which provide an axis about which the roll 36 rotates for dispensing the material 38 (FIG. 2). Brake springs 72 contiguous to the roll 36 may be employed to provide a frictional and compressive force to retard overspin of the roll 36 during dispensing. The adapters 52 are preferably designed to facilitate ease of rotation of the core 54 about the roll bearing surface 58. One possible way to accomplish this is to manufacture the roll bearing surface 58 using a material having a low dynamic coefficient of friction, such as, for example, polytetrafluoroethylene. Further, as seen in FIG. 4, the interface 74 between the roll bearing surface 58 and the projection surface 60 may be curvilinear and may correspond to the curvature of the core 54 of the roll 36 so that the roll 36 rests and rotates on the bearing surface 58 without hindrance by undesirable frictional forces.

When the roll 36 has been completely dispensed, one may simply reach into the dispenser 20 and bend the core 54 so that the adapters 52 no longer extend into the core 54. The core 54 may then be removed from the dispenser 20 and discarded as desired.

In some circumstances it is desirable to remove a full roll 36 or a partially dispensed roll 36. Removal of a partially dispensed roll 36 from the dispenser 20 may be appropriate where a period of heavy use of the dispenser 20 is anticipated, during which there may not be an opportunity to refill the dispenser 20. It may also be necessary to remove a full or partially dispensed roll 36 if it becomes contaminated or damaged.

Figure 4:
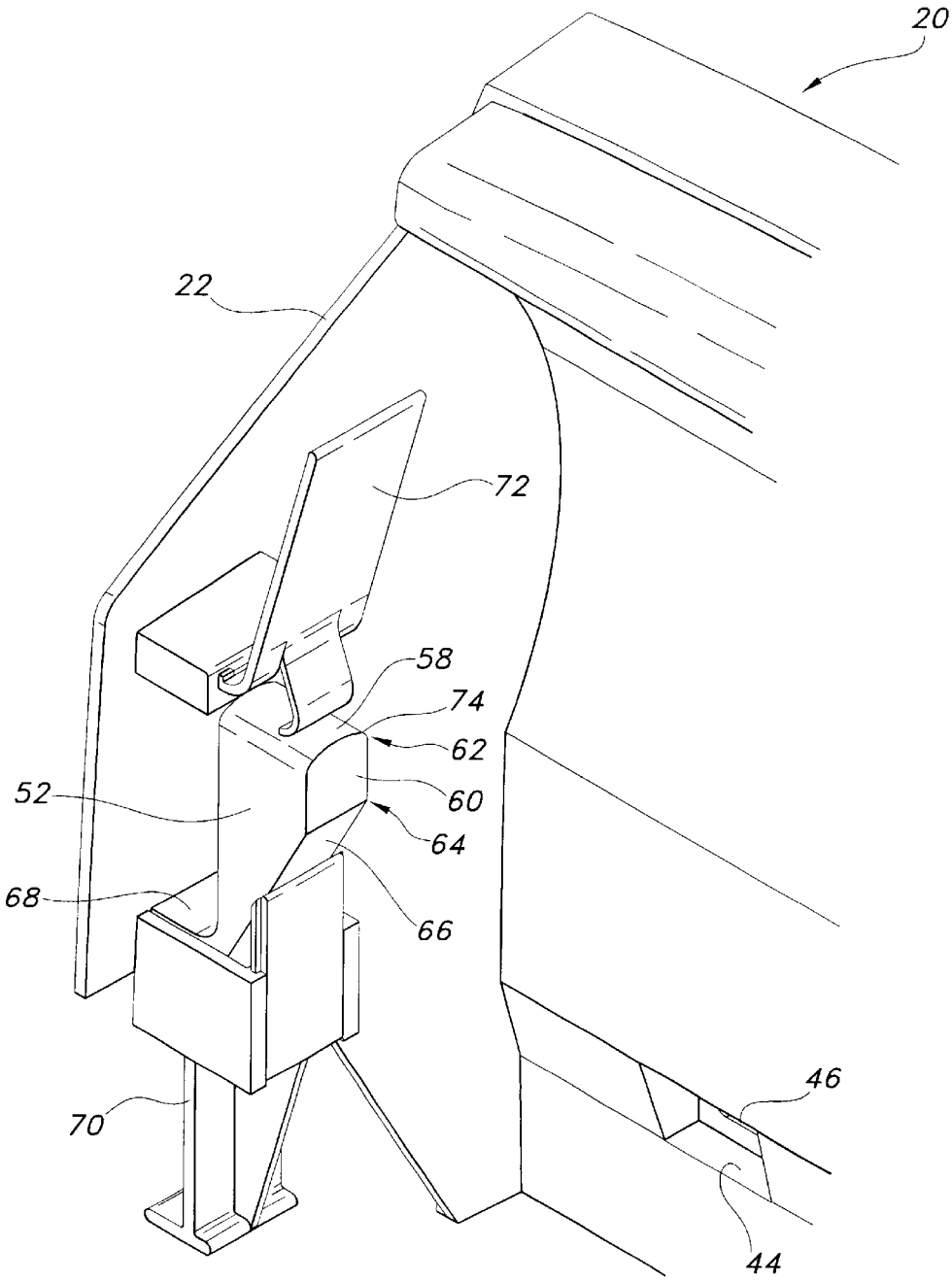
FIG. 4 is a perspective view of an adapter in a dispenser.
Figure 5:
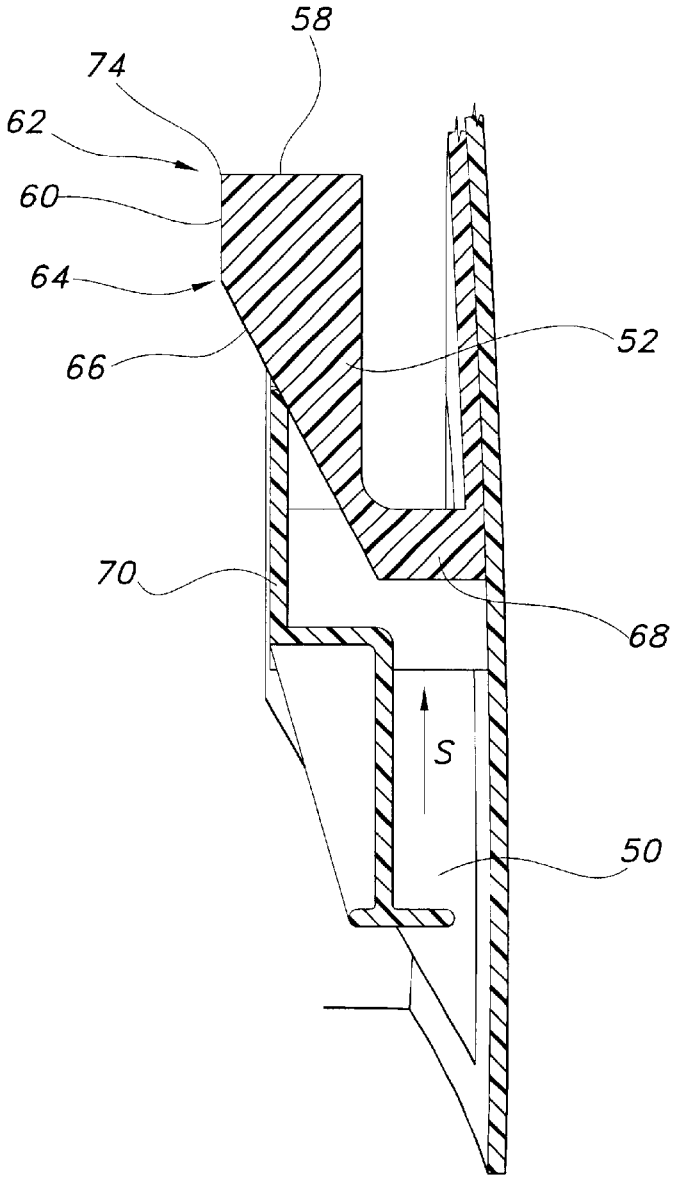
FIG. 5 illustrates an exemplary release mechanism.

To remove the full roll 36, the user may employ one or more release mechanisms 70 as represented by FIGS. 3–5. When the user actuates the release mechanism 70, the adapter 52 deflects in a direction X away from its opposed adapter 52, disengaging the adapter 52 from the core 54 of the roll 36. The user then manually removes the roll 36 from the opposed adapter 52 and removes the roll 36 from the housing 22. Where a release mechanism 70 is provided for two opposed adapters 52, the simultaneous activation of both release mechanisms 70 will cause the adapters 52 to completely disengage the core 54 of the roll 36. The roll 36 then drops downward from the dispenser 20 and may be removed. In one embodiment depicted in FIG. 5, the release mechanism 70 slidably engages the adapter 52 when pushed in a direction S away from the opening 34. In another embodiment not shown, the user must engage a push button or the like to actuate the release mechanism 70. Alternative methods of releasing the roll 36 are possible and will be known to those skilled in the art. Such alternatives are contemplated by the present invention.

To remove a partially dispensed roll 36, the roll 36 is pushed within the dispenser 20 in a direction Y away from the opening 34 (FIG. 3). The exertion of a biasing force by the core 54 against the actuating surface 66 causes the adapters 52 to deflect in a direction X away from the opposed adapter 52 (FIG. 3). When the core of the roll 36 is no longer engaged, the roll 36 is pushed toward the back of the housing 22, where it drops toward the opening 34 and is manually removed.

In some embodiments such as that shown in FIG. 2, the dispenser 20 may further include adapters 52 having a connecting portion 68 contiguous to the actuating surface 66 and distal to the projection surface 60 for joining the adapters 52 to the opposed rigid surfaces. Where the adapters 52 and the rigid surfaces are made of a moldable material such as metal or plastic, the adapters 52 and the rigid surfaces may be a unitary piece, optionally separated by a connecting portion 68. Alternatively, the adapters 52 may be separately mounted to the rigid surfaces, for example, opposed walls 24, 26 of the dispenser 20. The connecting portion 68 should be designed to position the roll bearing surface 58 sufficiently distal to the opposed rigid surfaces to permit adequate deflection for insertion or removal of the roll 36.

In one possible embodiment depicted in FIG. 2, the connecting portion 68 has a profile that is substantially linear. However, the connecting portion 68 may have any profile, including, but not limited to, an L-shape (not shown) or a U-shape (not shown). A connecting portion 68 having a particular profile may be desirable to attain the required deflection of the adapter 52 or to accommodate the design of the dispenser 20.

An additional consideration in designing the adapter 52 is whether a fillet radius should be used at points of high stress. Sharp corners at the juncture between the adapter 52 and the rigid surface to which it is mounted and at the juncture between the actuating surface 66 and the connecting portion 68 (where used) may be points of high stress during loading and unloading the roll 36 at which yielding or breakage may occur. Use of a fillet radius may help to alleviate the stress and extend the life of the adapter 52.

The adapters 52 may be made of any suitable material, such as a polymer, metal, or the like, provided that the material possesses sufficient flex characteristics at the desired adapter 52 dimensions. Further, the adapter 52 surfaces may have any thickness, provided that the ability of the adapters 52 to deflect during insertion and removal of a roll 36 is not impeded. In some embodiments, the adapters 52 are formed from sufficiently flexible plastic using molding techniques known to those skilled in the art. Alternatively, the adapters 52 may be constructed of various components joined together thermally, adhesively, by solder, or the like.

Whether the adapter 52 possesses sufficient flexibility is governed by fundamental principles of mechanics. The adapter 52 will be deflected multiple times during insertion and removal of the roll 36, so it is imperative that the strain on the adapter 52 does not exceed the allowable dynamic strain on the particular material. Strain on the adapter 52 is a function of both the dimensions of the adapter 52 and its ability to deflect. Methods of calculating strain on the adapter 52 are well known to those of ordinary skill in the art. The maximum allowable dynamic strain for a given material is readily available from the material supplier and is often presented as a stress-strain curve. Suitable materials for the present invention may include, but are not limited to acrylonitrile-butadiene-styrene (ABS), nylon, aluminum, steel, and the like.

The invention may be embodied in other specific forms without departing from the scope and spirit of the inventive characteristics thereof. The present embodiments therefore are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A dispenser for dispensing a material from a mounted roll comprising:

a housing having at least two opposed walls forming an interior volume and an opening;

a means for dissociating the material from the roll disposed proximal to the opening;

at least one pair of cantilevered adapters mounted on the opposed walls within the interior volume in substantially coaxially aligned, spaced apart relation, at least one adapter comprising:

a roll bearing surface;

a projection surface having a first end and a second end such that the first end is substantially coterminous with the roll bearing surface forming an interface, and substantially perpendicular to the roll bearing surface at each point along the interface;

an actuating surface angularly coterminous with the second end of the projection surface; and a connecting portion contiguous to the actuating surface and distal to the projection surface for joining the adapters to the opposed walls, whereby the connecting portion positions the roll bearing surface sufficiently distal to the opposed walls to permit adequate deflection for insertion or removal of the roll, wherein the application of a biasing force to the actuating surface causes the adapters to deflect in a direction away from the opposed adapter, and removal of the biasing force causes the adapter to protrude toward the opposed adapter; and a brake spring disposed adjacent and above said bearing surface and contiguous to the mounted roll; said brake spring being enclosed by opposed walls.

2. The dispenser of claim 1, wherein the connecting portion permits adequate deflection for insertion or removal of the roll.

3. The dispenser of claim 1, wherein the projection surface is substantially parallel to the opposed walls.

4. The dispenser of claim 1, wherein the roll bearing surface is substantially perpendicular to the opposed walls.

5. The dispenser of claim 1, wherein the interface formed between the roll bearing surface and the projection surface is curvilinear.

6. A dispenser adapted to dispense a material from a mounted roll comprising:

a housing having a plurality of opposed walls forming an interior volume and an opening;

at least one pair of cantilevered adapters mounted on opposed walls within the interior volume in substantially coaxially aligned, spaced apart relation, at least one adapter comprising:

a roll bearing surface;

a projection surface having a first end and a second end such that the first end is substantially coterminous with the roll bearing surface forming an interface, and substantially perpendicular to the roll bearing surface at each point along the interface; and an actuating surface angularly coterminous with the second end of the projection surface, wherein the application of a biasing force to the actuating surface causes the adapters to deflect in a direction away from the opposed adapter, and removal of the biasing force causes the adapter to protrude toward its opposed adapter; and a brake spring disposed adjacent and above said bearing surface and contiguous to the mounted roll; said brake spring being enclosed by opposed walls.

7. The dispenser of claim 6, wherein the adapters further comprise a connecting portion contiguous to the actuating surface and distal to the projection surface for joining the adapters to the opposed walls.

8. The dispenser of claim 6, wherein the connecting portion positions the roll bearing surface sufficiently distal to the opposed walls, thereby permitting adequate deflection for insertion or removal of the roll.

9. The dispenser of claim 6, wherein the projection surface is substantially parallel to the opposed walls.

10. The dispenser of claim 6, wherein the roll bearing surface is substantially perpendicular to the opposed walls.

11. The dispenser of claim 6, wherein the interface formed between the roll bearing surface and the projection surface is curvilinear.

12. The dispenser of claim 6, wherein the interface formed between the roll bearing surface and the projection surface is linear.

* * * * *